US009266212B2

(12) United States Patent
Bruyns

(10) Patent No.: US 9,266,212 B2
(45) Date of Patent: Feb. 23, 2016

(54) SANDING DEVICES AND METHODS

(71) Applicant: Silhouette Sander, LLC, Madison, AL (US)

(72) Inventor: Roland Bruyns, Madison, AL (US)

(73) Assignee: Silhouette Sander, LLC, Madison, AL (US)

( * ) Notice: Subject to any disclaimer, the term of this patent is extended or adjusted under 35 U.S.C. 154(b) by 0 days.

(21) Appl. No.: 14/171,954

(22) Filed: Feb. 4, 2014

(65) Prior Publication Data

US 2014/0220870 A1 Aug. 7, 2014

Related U.S. Application Data

(60) Provisional application No. 61/760,945, filed on Feb. 5, 2013.

(51) Int. Cl.

| | |
|---|---|
| ***B24B 23/04*** | (2006.01) |
| ***B24D 15/04*** | (2006.01) |
| ***B24B 23/03*** | (2006.01) |

(52) U.S. Cl.

CPC ..... *B24B 23/03* (2013.01); *B24B 23/04* (2013.01); *B24D 15/04* (2013.01)

(58) Field of Classification Search

CPC .... B24B 23/00; B24B 23/04; B24B 27/0023; B24B 27/0076; B24D 15/04

USPC ..... 451/523, 524, 495, 484, 344, 351, 356, 451/357

See application file for complete search history.

(56) References Cited

U.S. PATENT DOCUMENTS

| | | | | |
|---|---|---|---|---|
| 3,167,889 | A * | 2/1965 | Jacobi | 451/303 |
| 3,517,466 | A * | 6/1970 | Bouvier | 451/490 |
| 3,755,972 | A | 9/1973 | Mogaki et al. | |
| 4,206,574 | A * | 6/1980 | Dotsko | 451/495 |
| 4,709,510 | A | 12/1987 | Giovanni et al. | |
| 4,802,309 | A * | 2/1989 | Heynacher | 451/41 |
| 5,140,784 | A * | 8/1992 | Walsh | 451/495 |
| 5,548,860 | A | 8/1996 | Weltikol et al. | |
| 6,234,887 | B1 | 5/2001 | Hundebol | |
| 6,283,842 | B1 * | 9/2001 | Collins | 451/495 |
| 6,638,151 | B2 * | 10/2003 | Ueno | 451/359 |
| 7,134,951 | B1 * | 11/2006 | Leon et al. | 451/520 |
| 8,210,909 | B2 * | 7/2012 | Bernardi et al. | 451/495 |
| 8,968,057 | B1 * | 3/2015 | Mor | 451/495 |
| 2001/0003087 | A1 | 6/2001 | Oda et al. | |
| 2001/0031614 | A1 | 10/2001 | Morkvenas | |
| 2001/0044268 | A1 | 11/2001 | Shendon | |
| 2002/0009951 | A1 * | 1/2002 | Smith et al. | 451/28 |
| 2003/0017796 | A1 | 1/2003 | Walker | |
| 2004/0077300 | A1 | 4/2004 | Thysell et al. | |
| 2011/0291342 | A1 * | 12/2011 | Gindy et al. | 269/266 |

* cited by examiner

*Primary Examiner* — Eileen Morgan
(74) *Attorney, Agent, or Firm* — Lanier Ford Shaver & Payne, P.C.; Ann I. Dennen

(57) ABSTRACT

The present disclosure describes a sanding device that has a motor coupled to a base plate for inducing vibration in the base plate. Further, the sanding device has a face plate that is coupled to the base plate, and the face plate has a plurality of sleeves for receiving a respective plurality of columns. The columns rotate and move longitudinally within the sleeves. Further, each column moves independent of the other columns and each column have an abrasive surface on a sanding end for contacting a sanding surface.

18 Claims, 5 Drawing Sheets

SANDING DEVICES AND METHODS

CROSS-REFERENCE TO RELATED APPLICATIONS

This application claims priority to Provisional Patent Application U.S. Ser. No. 61/760,945, entitled "Sanding Device and Method" and filed on Feb. 5, 2013, which is fully incorporated herein by reference.

BACKGROUND

Electric sanders, often referred to as sanding blocks or power sanders, are typically used when preparing surfaces for finishing or repairing furniture through abrasion. Typical sanders use abrasive paper, often referred to as sandpaper, to remove undesired surface material. In this regard, the typical sander couples to the sandpaper and moves the sandpaper across the surface in conjunction with a user manually moving the electric sander as well.

There a various types of electric sanders, including vibrating sanders. The vibrating sander usually comprises a flat plate to which the sandpaper is coupled via some type of latch or attachment mechanism. Once attached and the vibrating sander is operating, the vibrating sander moves the plate, thereby moving the sandpaper, in orbital motions, e.g., small circular motions, but not rotational. A user of the vibrating sander then manually moves the sander across the surface via a handle or grip, and the movement of the sandpaper via the plate coupled with movement induced by the user removes material from the surface that is being prepared.

FIG. 1 is an exemplary conventional sanding device 100 that sands even surfaces. The sanding device 100 comprises a motor housing 101 and a sandpaper plate 102. The sandpaper plate 102 is fitted with a piece of sand paper 103. The sandpaper plate 102 creates a flat surface for receiving the sand paper 103. Thus, as a user (not shown) is sanding, the sand paper 103 contacts a surface (not shown) of an object being sanded, and evenly sands the surface it contacts. If the object has an uneven surface with varying elevation anomalies, e.g., the surface has indentations, sporadically placed concavities, depressions, protrusions, bulges, bumps convexities, or adjacent differences in elevation, the sand paper 103 sands only the surface it contacts, regardless of the depth or height of such anomalies in the surface.

SUMMARY

The present disclosure describes a sanding device that has a motor coupled to a base plate for inducing vibration in the base plate. Further, the sanding device has a face plate that is coupled to the base plate, and the face plate has a plurality of sleeves for receiving a respective plurality of columns. The columns rotate and move longitudinally simultaneously within the sleeves. Further, each column moves independent of the other columns and has an abrasive surface on a sanding end for contacting a sanding surface.

In addition, a method in accordance with an embodiment of the present disclosure encompasses the following: (1) coupling a motor to a base plate for inducing vibration in the base plate; (2) coupling a face plate to the base plate, and the face plate has a plurality of sleeves for receiving a respective plurality of columns that rotate and move longitudinally within the sleeves, each column moving independent of the other columns and each column comprising an abrasive surface on a sanding end for contacting a sanding surface; and (3) contacting the sanding surface with the abrasive surface on the sanding ends of the columns

BRIEF DESCRIPTION OF THE DRAWINGS

The present disclosure is described with reference to the accompanying drawings. The systems and methods described can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DISCLOSURE

The present disclosure describes sanding devices that sand, polish, or buff a surface of an object substantially evenly regardless of anomalies existing on the surface. The sanding devices of the present disclosure sand surfaces, which are flat, contoured or otherwise have some uneven surface topography in a substantially even and consistent manner.

In one embodiment, the sanding device of the present disclosure comprises a plurality of extendible shafts or columns that move independently one from the other. The independent movement of each shaft is such that abrasive material on an end of a first shaft may interface one portion of the surface at a particular elevation while abrasive material on an end of a second shaft adjacent the first shaft may interface with a second portion of the surface at a different elevation. The independent movement of the shafts allows substantially equal sanding pressure to be applied to surfaces at different elevations.

In operation, the sanding device is configured to translate rotational motion of a motor into longitudinal motion of a shaft. This translation of motion results in each shaft extending toward and contacting the surface of the object. Abrasive contacts on ends of the shafts contact the surface of the object and provide the desired surface finishing treatment.

Figure 2A:
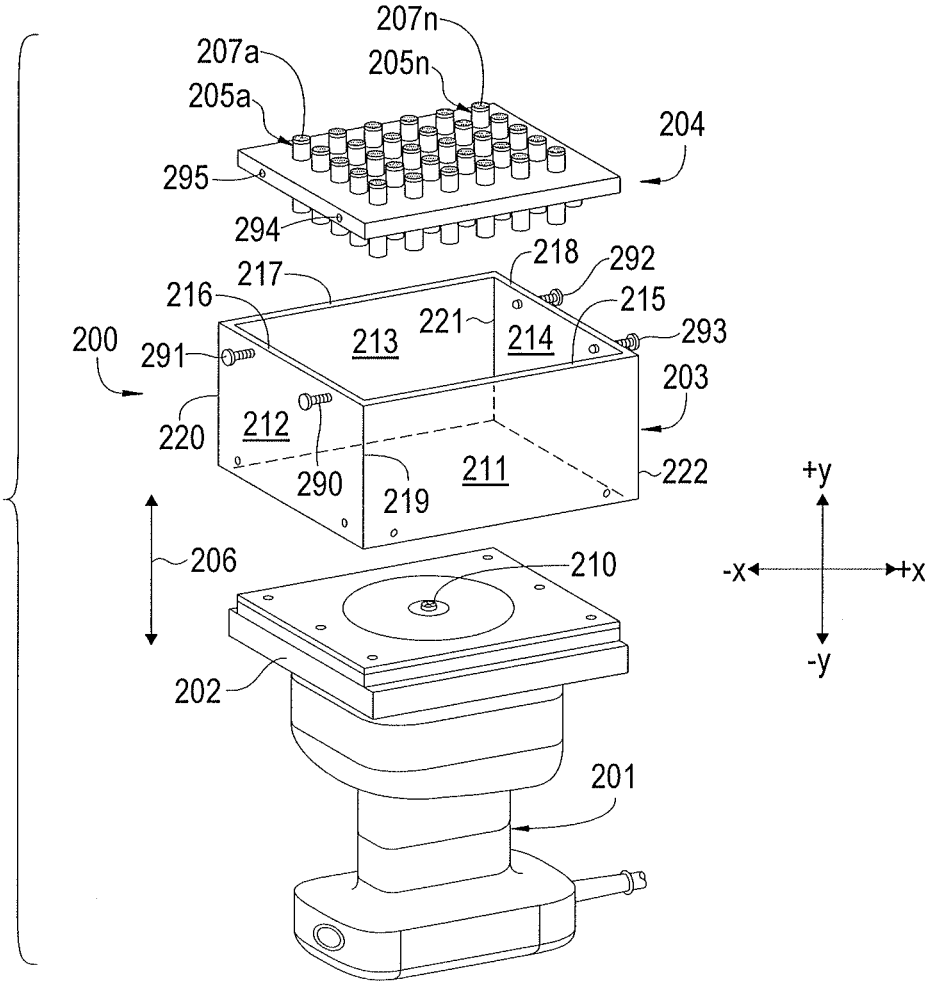
FIG. 2A is a perspective partially exploded view of a sanding device in accordance with an embodiment of the present disclosure.

FIG. 2A is an exploded perspective view of a sanding device 200 in accordance with an embodiment of the present disclosure. The sanding device 200 comprises a motor housing 201 and a base plate 202. The motor housing 201 houses a motor (not shown). The motor may be electric or air driven and is configured to interface with the base plate 202 via a fastener 210. The fastener 210 may be, for example, a screw.

In operation, as the motor rotates, the base plate 202 vibrates with a circular force in a plane normal to the axis of the motor, which is described further herein. The consequence of the vibration resulting from the circular force is described further herein.

Additionally, the sanding device 200 comprises an extension housing 203, e.g., in the shape of a box. Note that the extension housing 203 may be other shapes in other embodiments. In operation, the extension housing 203 is fixedly coupled to the base plate 202 via one or more fasteners (not shown). Notably, the vibration of the base plate 202 resulting from the circular force described hereinabove results in a similar vibration in the extension housing 203 when the extension housing 203 is fixedly coupled to the base plate 202.

In the embodiment depicted, the extension housing 203 comprises four walls 211-214 coupled consecutively one to the other at corner edges 219-222. Thus, the walls 211-214 form a square or rectangular box, as described hereinabove. However, the rectangular shape of the extension housing 203 is not pivotal. Note, for example, the extension housing 203 could be cylindrical and having only a single contiguous wall (not shown) and having no corner edges 219-222.

Additionally, the sanding device 200 comprises a face plate assembly 204. The face plate assembly 204 is coupled to the extension housing 203. The face plate assembly 204 is configured such that it may be removed and replaced so that different face plate assemblies may be used in other embodiments. In this regard, the face plate assembly 204 may be coupled to edges 215-218 of the walls 211-214 or may be coupled directly to the walls 211-214 via fasteners (not shown) or a type of removable adhesive.

Figure 2B:
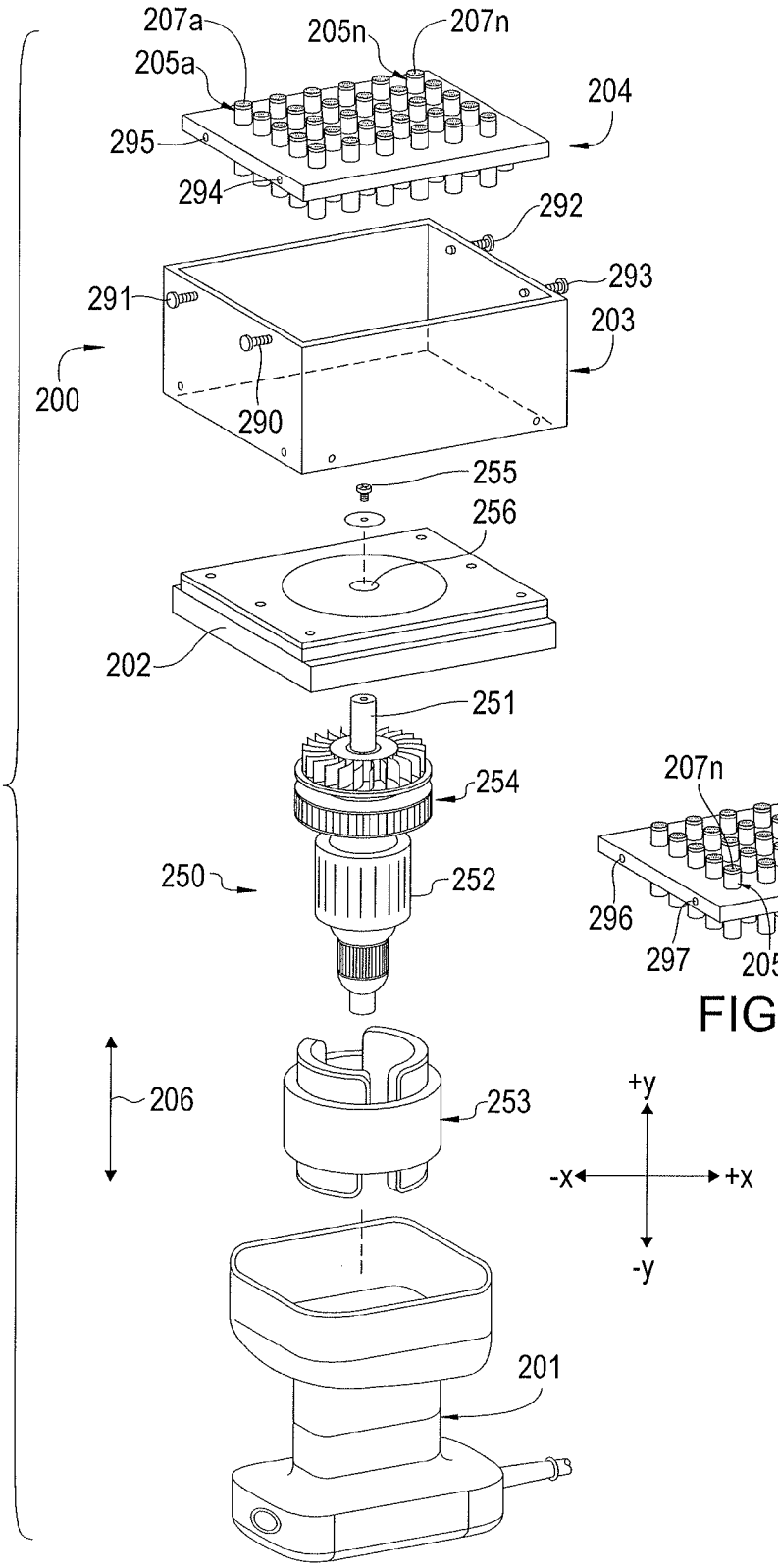
FIG. 2B is a perspective partially exploded view of a motor housing of the sanding device of FIG. 2A.
Figure 2C:
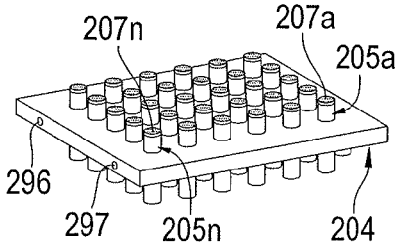
FIG. 2C is a perspective view of a plate assembly of FIG. 2B.

As shown in FIG. 2A, the faceplate 204 may comprise threaded openings 294 and 295 and corresponding threaded openings 296 and 297 as shown in FIG. 2C. In such an embodiment, the extension housing 203 may have a plurality of fasteners, e.g., screws 290-291, that coupled to the threaded openings 294-297 to secure the faceplate 204 to the extension housing 203. Note that screws and threaded openings are an exemplary method of securing the faceplate 204 to the extension housing 203. However, other types of structures and/or methods may be employed in other embodiments to secure the faceplate 204 to the extension housing 203. For example, the faceplate 204 may be secured to the extension housing 203 via latches.

As noted, the faceplate 204 is secured to the extension housing 203. Thus, during operation the vibration of the base plate 202 resulting from the circular force described hereinabove results in a similar vibration in the face plate 204 when the face plate 204 is coupled to the extension housing 203.

The face plate assembly 204 has a plurality of sleeves (not shown, but shown in FIG. 4A) with columns 205*a*-205*n* rotatably and movably coupled within each sleeve. In this regard, as the base plate 202 rotationally vibrates (e.g., in a circular motion as described hereinabove), the extension housing 203 rotationally vibrates thereby rotationally vibrating the face plate 204 in a circular motion. The circular motion induced in the face plate 204 causes the columns 205*a*-205*n* to rotate within the sleeves. However, each of the columns 205*a*-205*n* rotates independently from any of the other columns 205*a*-205*n*.

The end of each column 205*a*-205*n* that interfaces with a sanding surface (not shown) is coupled to an abrasive pad 207*a*-207*n* (or other abrasive structure) for contacting and sanding the surface. Note that the sanding device 200 has a number of sleeves corresponding to the number of columns 205*a*-205*n* employed. For example, if the sanding device 200 has four sleeves, each sleeve receives one of four columns 205*a*-205*n*. The face plate assembly 204 is described further with reference to FIG. 3-5.

FIG. 2B depicts an exploded view of the housing 201 of the sanding device 200. In this regard, the housing 201 encloses a stator component 253 and a rotor component 250. The rotor component 250 may comprise a rotor 252 and a fan 254. In addition, the rotor component 250 comprises a shaft 251 that rotates when in operation.

The shaft 251 is coupled to a cylindrical channel 256 in the base plate 202. The rotor component 250 is fixedly and rotatably coupled, via the shaft 251, to the base plate 202 via a fastener 255, which may consist of a screw and a washer, for example.

During operation, the rotor component 250 rotates either clockwise or counter clockwise, which causes the shaft 251 and the fastener 255 to rotate in the opening 256. The orbiting rotation induces an orbital vibration of the base plate 202. The orbital vibration of the base plate 202 induces rotational and longitudinal movement in each of the columns 205*a*-205*n* in the +y direction. However, if pressure is applied to the ends of the columns 205*a*-205*n* on which the abrasive pads 207*a*-207*n* are coupled, e.g., if the abrasive pads 207*a*-207*n* are moved across the surface that is being sanded, the pressure applied causes one or more of the columns 205*a*-205*n* to move in the −y direction. Thus, an uneven surface may cause one or more of the columns 205*a*-205*n* to move in the −y direction while other columns 205*a*-205*n* stay stationary or move in the +y direction simultaneously.

In this regard, when the abrasive pads 207*a*-207*n* are placed in contact with the surface and a user applies a +y directional force on the housing 201 toward the surface, the columns 205*a*-205*n* adjust in a +/−y direction (as indicated by reference arrow 206) as the topography of the surface being contacted by the abrasive pads 207*a*-207*n* changes in elevation.

The sleeve and column interface provides for a radial clearance between an inside surface of the sleeve and an outer surface of the column 205*a*-205*n*. The clearance allows radial and axial motion between the two. The clearance allows motion between the inside surface of the sleeve and the outside surface of the column 205*a*-205*n* and also allows orbital motion of the base plate 202 to be transferred to the individual columns 205*a*-205*n*.

Figure 3:
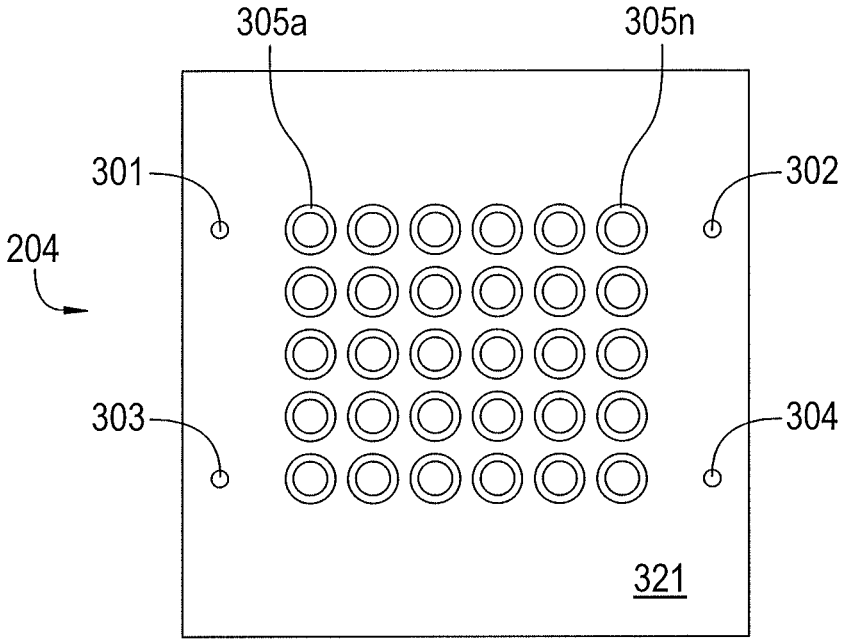
FIG. 3 is plan view of a sanding side of an exemplary face plate of the sanding device of FIG. 2A.

FIG. 3 is a plan view of a surface 321 of the face plate assembly 204. The surface 321 is adjacent to the sanding surface, and during operation the columns extend from the surface 321.

In the embodiment shown, the face plate assembly 204 comprises openings 301-304 for receiving screws (not shown). The screws coupled the face plate assembly 204 to the extension housing 203.

The face plate assembly 204 further comprises a plurality of sleeves 305*a*-305*n*. Each sleeve 305*a*-305*n* receives one of the columns 205*a*-205*n*. As described hereinabove, the interface between the columns 205*a*-205*n* has a radial clearance, which allows the columns 205*a*-205*n* to be rotatably and longitudinally movable within the sleeves 305*a*-305*n*.

Figure 1:
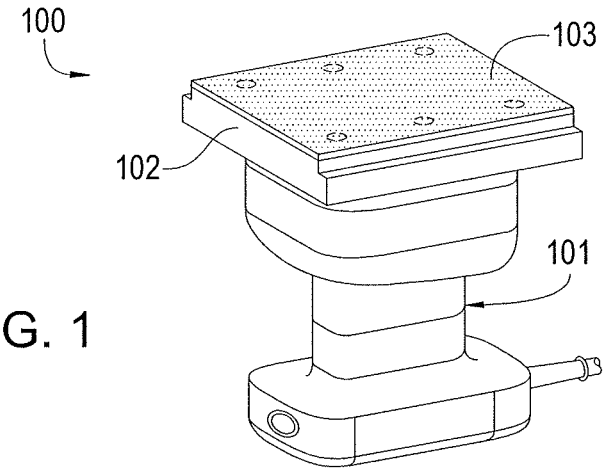
FIG. 1 is a perspective view of a conventional sanding device.
Figure 4A:
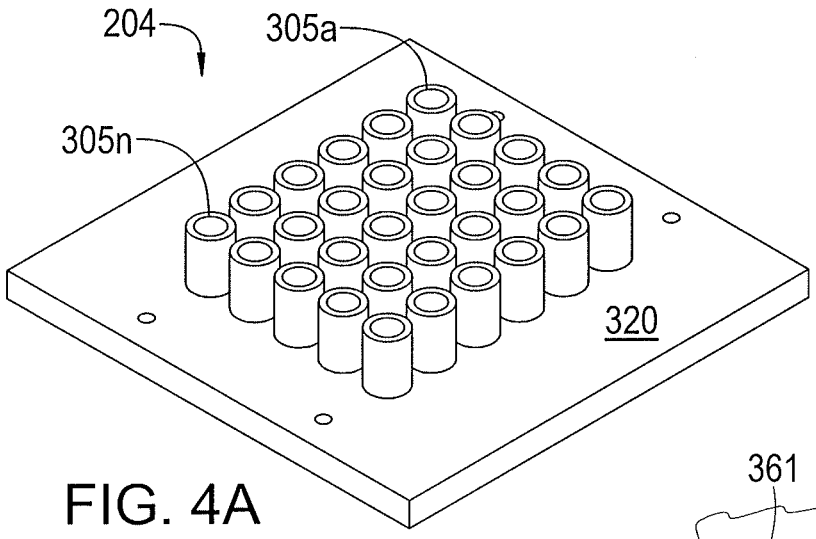
FIG. 4A is a perspective view of an opposing side of the face plate of FIG. 3.

FIG. 4A is a perspective view of the face plate assembly 204 showing an opposing surface 320 of the face plate assembly shown in FIG. 3. As shown, the sleeves 305*a*-305*n* extend from the side 320 of the face plate assembly 204. The sleeves 305*a*-305*n* are hollow for receiving respective columns 205*a*-205*n* (FIG. 1).

Figure 4B:
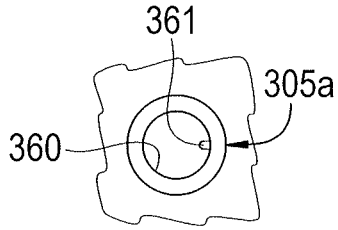
FIG. 4B is an end view of a sleeve of the face plate of FIG. 4A.

FIG. 4B is an end view of the sleeve 305*a*. The sleeve 305*a* comprises a guide element 361 that protrudes from an inner cylindrical surface 360 of the sleeve 305*a*. The guide element 361 is adapted and arranged to couple to a helical groove (shown in FIG. 5) and is also coupled to or integral with the inside surface 360 of the sleeve 305*a*.

In the embodiment shown, the guide element is a pin that protrudes from the surface 360; however, the guide element 361 may be a rib, a thread, or any other type of protrusion for guiding the column 205*a*-205*n* in a rotating path as the column 205*a*-205*n* vibrates in a plane normal to the longitudinal direction, e.g., the +/−y direction, as the shaft 251 (FIG. 2B) vibrates the face plate assembly 204.

Figure 5:
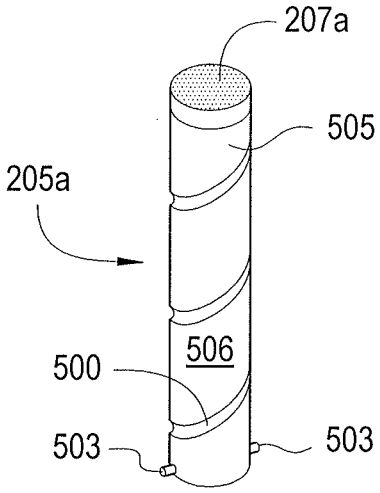
FIG. 5 is a perspective of an exemplary column of the sanding device of FIG. 2A.

In this regard, FIG. 5 is a perspective view of an exemplary column 205*a*-205*n*. The exemplary column 205*a* has a track element 500. In one embodiment, the track element 500 is a helical groove, as shown. The track element 500 couples to the guide element 361 (FIG. 4A). Coupling of the track element 500 to the guide element 361 ensures guided longitudinal motion of the column 205*a* through the sleeve 305*a* (FIG. 3). In the embodiment shown, the track element 500 is a helical groove that receives the guide element 361 when the guide element is a protrusion. However, other coupling structures may be used in other embodiments of the sanding device 200, as described further herein. Changing the pitch of the helical groove will result in a change of the force applied by the exemplary columns 205*a*-205*n*.

Further, the column 205*a* comprises the abrasive pad 207*a* on an end 505 that contacts the sanding surface. On an opposing end 504, the column 205*a* comprises a stop component 503. The stop component 503 protrudes from an outside surface 506 of the column 205*a*. The stop component 503 may be a pin, as shown, or it may be any type of structure that ensures that the column 205*a* remains within a sleeve 305*a* during operation. There may also be a similar stop component on an end 505 of the column 205*a*.

During operation, when the guide element 361 (FIG. 4B) is coupled to the track element 500, orbital vibration of the base plate 202 (FIG. 2A) translates into orbital vibration of the face plate 202 and longitudinal motion of columns 205*a*-205*n* as shown by reference arrow 206 (FIG. 2A).

Note that the direction of twist or "handedness" of the track element 500 interacts to the orbital motion such that the columns 205*a*-205*n* extend in the +y direction as described with reference to FIG. 2A and thus in direction of the sanding surface or any object that a user desires to sand.

In one embodiment, longitudinal motion in either direction of the columns 205*a*-205*n* is limited within the sleeves 305*a*-305*n*.

In one embodiment, the columns 205*a*-205*n* have larger diameters at their ends or the column 205*a* has the stop component 503 that prevents continued motion past the pin, rib, thread, or other protruding guide structure.

In another embodiment, translation of orbital motion (of the base plate 202) into longitudinal (or +/−y) motion can also be accomplished by using other coupling structures. In this regard, the track element 500 may be a protruding structure (not shown) on the column 205*a*-205*n* and the guide element 361 may be a threaded sleeve (not shown), multiple protrusions in the sleeve, or a full or partial circumference rib in the sleeve. In even another embodiment, translation is accomplished by having a groove (not shown) in the sleeve and pin(s), protuberance, rib or threads on the columns 205*a*-205*n*. In another embodiment, translation is accomplished by having a threaded column and a threaded sleeve.

Figure 6:
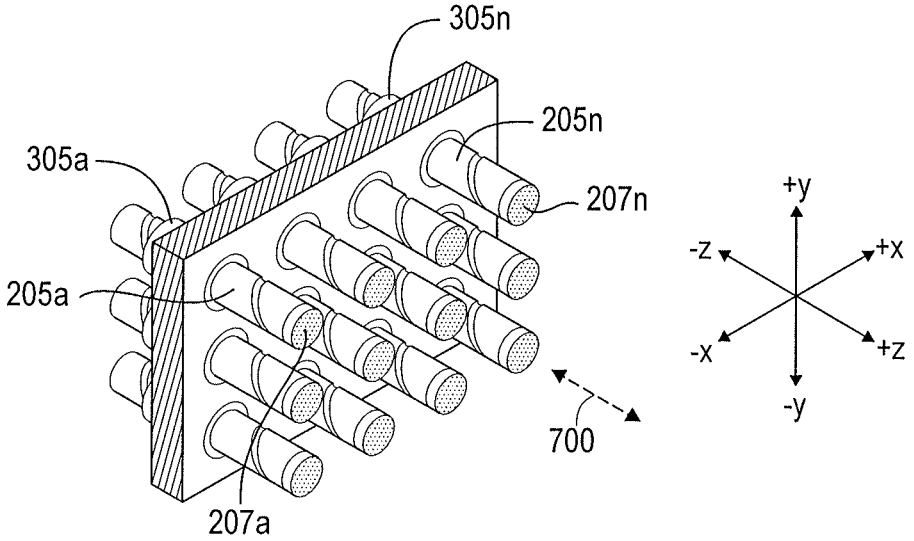
FIG. 6 is a perspective view of the face plate of the sanding device of FIG. 2A.

FIG. 6 is a perspective view of the face plate assembly 204. The columns 205*a*-205*n* are inserted within the sleeves 305*a*-305*n*. In operation, when orbital motion occurs in the x/y plane, the columns 205*a*-205*n* move in a +/−z direction as indicated by reference arrow 700.

The abrasive pads 207*a*-207*n* contacting the sanding surface (not shown) of an object is an abrasive surface or a surface otherwise suitable for surface finishing. The abrasive pads 207*a*-207*n* contacting the surface to be treated may be a shape that is different from the column 205*a* shown in FIG. 5.

Figure 7A:
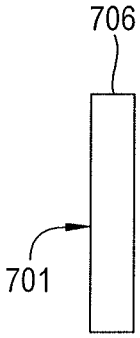
FIG. 7A is a side view of an exemplary embodiment of a flat sanding tip of the column of the sanding device of FIG. 2A.
Figure 7B:
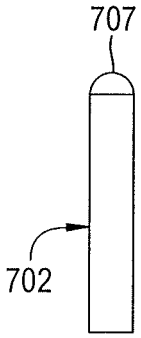
FIG. 7B is a side view of an exemplary embodiment of a rounded sanding tip of the column of the sanding device of FIG. 2A.
Figure 7C:
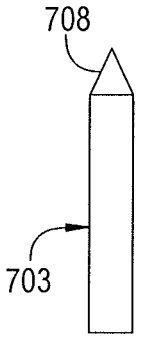
FIG. 7C is a side view of an exemplary embodiment of a pointed sanding tip of the column of the sanding device of FIG. 2A.
Figure 7D:
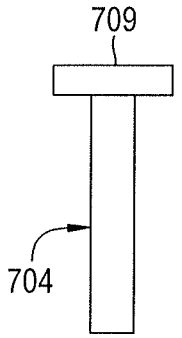
FIG. 7D is a side view of an exemplary embodiment of a shelf sanding tip of the column of the sanding device of FIG. 2A.
Figure 7E:
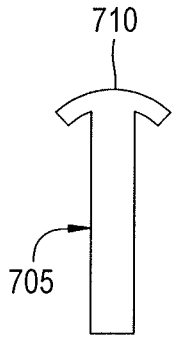
FIG. 7E is a side view of an exemplary embodiment of an arched sanding tip of the column of the sanding device of FIG. 2A.

In this regard, FIGS. 7A-7E show other column shapes that may be used in other embodiments of the present disclosure. FIG. 7A is a side view of an exemplary column 701 having a flat surface 706 for contacting the sanding surface. Further, FIG. 7B is a side view of an exemplary column 702 having a rounded surface 707, FIG. 7C is a side view of a column 703 having a pointed surface 708, and FIG. 7D is a side view of a column 704 having a shelf-like flat surface 709. Additionally, FIG. 7E is a side view of a column 705 having an arched surface 710 for contacting the sanding surface.

These alternate column tip shapes are provided as examples and are not intended to limit possible tip shapes to only those examples provided. Additionally the tip of the column may be covered with a layer of foam, rubber or any other type of compressible or viscoelastic material between the column and the abrasive material.

Figure 8:
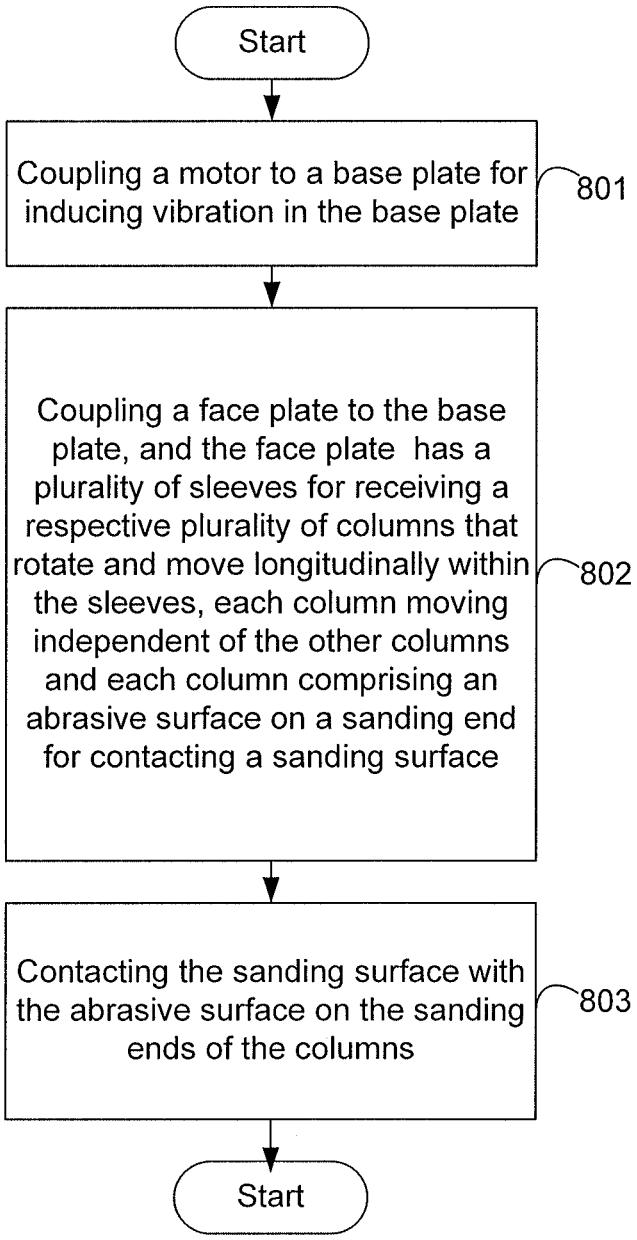
FIG. 8 is a flowchart depicting exemplary architecture and functionality of backend control logic depicted in FIG. 4.

FIG. 8 depicts an exemplary method in accordance with an embodiment of the present disclosure. In this regard, the method comprises coupling a motor to a base plate for inducing circular vibration in the base plate in step 800.

Step 801 is coupling a face plate to the base plate. The face plate has a plurality of sleeves for receiving a respective plurality of columns that rotate and move longitudinally within the sleeves. Further, each column moves independent of the other columns and each column comprises an abrasive surface on a sanding end for contacting a sanding surface.

Step 802 is contacting the sanding surface with the abrasive surface on the sanding ends of the columns.

What is claimed is:

1. A sanding device, comprising:

a motor coupled to a base plate for inducing rotational vibration in the base plate;

a face plate coupled to the base plate such that the rotational vibration in the base plate causes rotational vibration of the face plate, the face plate comprising a plurality of sleeves for receiving a respective plurality of columns that rotate and move longitudinally within the sleeves in response to the rotational vibration of the face plate, each column moving independent of the other columns and each column comprising an abrasive surface on a sanding end for contacting a sanding surface.

2. The sanding device of claim 1, wherein the sleeve further comprises a guide element and the column further comprises a track element and wherein the track element couples to the guide element such that the column rotates and moves longitudinally in the sleeve.

3. The sanding device of claim 2, wherein the track element is a helical groove in an outside surface of the column.

4. The sanding device of claim 3, wherein the guide element is a protrusion coupled to an inner surface of the sleeve.

5. The sanding device of claim 4, wherein the helical groove receives the protrusion and when in operation, coupling of the groove to the protrusion causes the column to rotate and move longitudinally within the sleeve.

6. The sanding device of claim 1, wherein each column comprises a stop component on an opposing end from the sanding end.

7. The sanding device of claim 6, wherein the stop component is a protrusion that is integral with an outside surface of the column.

8. The sanding device of claim 1, further comprising an extension housing that couples to the base plate and the face plate.

9. The sanding device of claim 8, wherein the extension housing is rectangular.

10. A sanding method, comprising:

coupling a motor to a base plate for inducing rotational vibration in the base plate;

coupling a face plate to the base plate such that the rotational vibration in the base plate causes rotational vibration of the face plate, the face plate comprising a plurality of sleeves for receiving a respective plurality of columns that rotate and move longitudinally within the sleeves in response to the rotational vibration of the face plate, each column moving independent of the other columns and each column comprising an abrasive surface on a sanding end for contacting a sanding surface; and contacting the sanding surface with the abrasive surface on the sanding ends of the columns.

11. The sanding method of claim 10, wherein the coupling the face plate to the base plate further comprises coupling guide elements on the sleeves with respective track elements on the columns such that the column rotates and moves longitudinally in the sleeve.

12. The sanding method of claim 11, wherein the track element is a helical groove in an outside surface of the column in the coupling the face plate to the base plate.

13. The sanding method of claim 12, wherein the guide element is a protrusion coupled to an inner surface of the sleeve in the coupling the face plate to the base plate.

14. The sanding method of claim 13, wherein the coupling the face plate to the base plate further comprises the helical groove receiving the protrusion and when in operation, coupling of the groove to the protrusion causes the column to rotate and move longitudinally within the sleeve.

15. The sanding method of claim 10, further comprising longitudinally limiting movement of the columns within the sleeves via a stop component on an opposing end from the sanding end.

16. The sanding method of claim 15, wherein the longitudinally limiting movement comprises a protrusion that is integral with an outside surface of the column.

17. The sanding method of claim 10, further comprising extending the face plate from the base plate via an extension housing that couples to the base plate and the face plate.

18. The sanding method of claim 17, wherein the extending further comprising extending the face plate from the base plate with an extension housing that is rectangular.

* * * * *